United States Patent [19]

Yamada et al.

[11] Patent Number: 4,977,737

[45] Date of Patent: Dec. 18, 1990

[54] METHOD OF CONTROLLING THE DRIVING OF A RING SPINNING FRAME

[75] Inventors: Koichi Yamada; Hiroshi Enomoto, both of Aichi; Osamu Yoshida, Gifu, all of Japan

[73] Assignee: Howa Machinery, Ltd., Aichi, Japan

[21] Appl. No.: 502,758

[22] Filed: Apr. 2, 1990

[30] Foreign Application Priority Data

Apr. 7, 1989 [JP] Japan ..... 1-89078

[51] Int. Cl.[5] ..... D01H 1/22; D01H 1/26; D01H 5/32; D01H 5/38

[52] U.S. Cl. ..... 57/97; 57/93; 57/264

[58] Field of Search ..... 57/93, 94, 96, 97, 264, 57/102, 276, 277

[56] References Cited

U.S. PATENT DOCUMENTS

| | | | |
|---|---|---|---|
| 2,168,449 | 8/1939 | Reich | 57/97 |
| 2,682,144 | 6/1954 | Hare | 57/97 |
| 2,982,083 | 5/1961 | Breitenbach | 57/97 |
| 4,375,744 | 3/1983 | Briner et al. | 57/96 |
| 4,409,785 | 10/1983 | Nakane et al. | 57/96 X |
| 4,551,969 | 11/1985 | Kogiso et al. | 57/264 |
| 4,569,192 | 2/1986 | Yamada et al. | 57/264 X |

*Primary Examiner*—John Petrakes

*Attorney, Agent, or Firm*—Stevens, Davis, Miller & Mosher

[57] ABSTRACT

In the high speed driving of a ring spinning frame provided with a plurality of ring-spinning twisting-winding units, to compensate for the possible loss of thickness of yarn produced, when the drive speed of the spindles reaches more than a predetermined rotation speed, such as 16,000 rpm in the case of spinning a cotton yarn of 40's, a total draft ratio of each drafting part of the ring spinning frame is regulated to maintain the expected yarn count according to a predetermined compensation program.

3 Claims, 6 Drawing Sheets

METHOD OF CONTROLLING THE DRIVING OF A RING SPINNING FRAME

BACKGROUND OF THE INVENTION

1. Field of the Invention

The present invention relates to a method of driving a ring spinning frame, more particularly, it relates to a method of controlling the driving of a ring spinning frame wherein spindles are driven at a very high rotation speed.

2. Description of the Related Art

In the method of driving a ring spinning frame, it is well known that the rotation speed of spindles is controlled by a control program whereby, during the driving operation for producing a full packaged cop of yarn by each ring-spindle winding unit of the ring spinning frame, the rotation speed of each spindle is increased from the starting of the driving operation until the bottom tapered portion of a cop is formed. At this point, the rotation speed of each spindle reaches the maximum speed thereof, and the driving speed of each spindle is maintained until the yarn volume of the cop of each spindle become 90% of the full packaged cop, and thereafter the driving speed of each spindle is lowered to zero and the production of the full packaged cops by the ring spinning frame is completed. The main purpose of driving the spindles of a ring spinning frame according to the above-mentioned program control method is to prevent possible yarn breakages during the period of forming the above-mentioned bottom tapered portion and of forming a top tapered portion of each full packaged cop, as disclosed in Japanese Unexamined Patent Publication Sho No. 61 (1986) 201,028, and Japanese Unexamined U.M. Publication Sho No. 63 (1988) 64,781.

Currently, since the accuracy of machined elements has become very high due to the remarkable developments in machine tools, it is easy to obtain machine elements related to the ring-spindle mechanism that have a high machine accuracy and high quality, and accordingly, it is possible to increase the driving speed of the spindles to a high level of more than 25,000 rpm, which is remarkably higher than the driving speed of spindles of conventional ring spinning frames. Such a high speed driving of spindles causes several serious problems, such as an excessive vibration of the machine elements, and the creation of loud noise, etc., but such problems have been solved by modern technology. Nevertheless, although a skilled person in the art recognizes the above-mentioned problems related to the high speed driving of the ring spinning frame, there is no recognition of more serious problems such as an acceptable variation of yarn count. Accordingly, the above-mentioned program control method of regulating the rotation speed of spindles has been only applied to modernize the spinning operation.

Under the above general situation it was found that, when the rotation speed of spindles of a ring spinning frame reaches more than a certain limit, such as 26,000 rpm, the thickness of yarn produced under such a driving condition of the spindle becomes thinner than the expected thickness, (hereinafter referred to as "loss of yarn thickness") as recognized after repeated tests, and it is obvious that the above change of the yarn thickness cannot be neglected, from the viewpoint of quality control. Accordingly, the purpose of the present invention is to practically solve the above serious problem from the viewpoint of quality control.

SUMMARY OF THE INVENTION

Repeated spinning tests have been carried out to determine why this serious problem arises of a reduction of the thickness of yarn produced under a high rotation speed of spindles over a certain limit, and as a result, it was found that there is a strong relationship between the rotation speed of the spindles and the degree by which the thickness of the produced yarn is reduced. Accordingly, the draft of the draft parts of the ring spinning frame is now automatically changed to compensate for the loss of thickness of the produced yarn, based upon the rotation speed of the spindles to change stepwisely each time the rotation speed of the spindles is stepwisely increased so that the rotation speeds of the spindles are increased more than a predetermined speed, whereby a practical method of attaining the purpose of the present invention is obtained.

DESCRIPTION OF THE PREFERRED EMBODIMENTS

Figure 1:
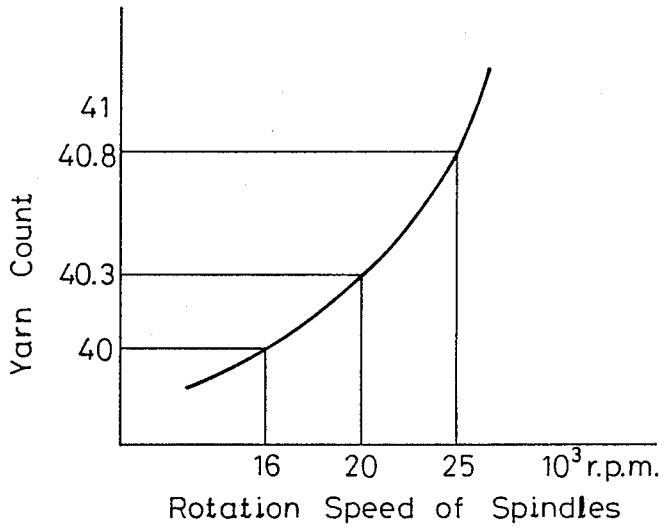
FIG. 1 illustrates a typical relationship between the rotation speed of the spindles and a change of the yarn count.

Before explaining the preferred embodiments of the present invention, the serious problem of a possible loss of yarn thickness occurring when the spindles of a ring spinning frame are driven at a speed higher than an upper limit of the rotation speed of the spindles, is first explained in detail, and then the basic technical concept of the present invention with regard to the solution to this problem is explained.

To solve the problem due to the creation of a loss of yarn thickness when the rotation speed of spindles of a ring spinning frame is higher than a certain upper limit thereof, it is necessary to analyze this problem to determined the basic physical reason for this phenomenon. Accordingly, an experimental test was applied to a process for producing a cotton yarn of 40's (cotton yarn count system) by a ring spinning frame, wherein a total draft of 30 was applied. It was confirmed that, when producing a yarn of 40's by applying a total draft of 30 under a spindle rotation speed of 16,000 rpm, if the rotation speed of the spindles is changed only while maintaining the total draft at 30, when the driving speed of the spindles is changed to 20,000 rpm, the yarn count of the produced yarn becomes 40.3, and when the driving speed of the spindles is changed to 25,000 rpm, the yarn count becomes 40.8. Also, the above-mentioned phenomenon of a loss of yarn thickness is continuously observed, as indicated by a line of exponential-function in FIG. 1, and a more remarkable loss of yarn thickness is observed at a very high speed rotation speed of the spindles of more than 25,000 rpm. From the point of view of quality control, the above-mentioned changes of the thickness of yarn cannot be neglected, and as hereinafter explained, the phenomenon of a loss of yarn thickness is created in all types of spun yarn, regardless of the yarn count, because when the rotation speed of the spindles is increased to very high rotation speed of more than 20,000 rpm, it was confirmed that there is a tendency for an increase of the volume of fibers flying in space during the spinning operation. The reason for this phenomenon can be understood from the following explanation.

First, we consider the spinning operation by a conventional spinning frame utilizing an apron draft mechanism, which comprises a pair of front rollers, a pair of back rollers, and a pair of aprons disposed in a space between the front rollers and the back rollers, wherein a fleece of fibers, delivered from a nipping zone formed between the aprons, is introduced to a nip point formed by the above-mentioned front rollers. In this spinning operation, the fleece of fibers delivered from the nip point of the front rollers is formed as a yarn upon leaving the nip point of the front rollers, by a propagating twisting action, and the yarn is wound on a cop by winding and twisting mechanisms each composed of a ring and a spindle, after passing through a snail wire. The following phenomenon can be observed when the drafted fleece of fibers delivered from the nip zone of the apron is introduced into the nip point of the front rollers. Namely, the fibers at the outside edge portions of the fleece of fibers have a tendency to move away from the main central portion thereof, and this phenomenon becomes remarkable when the rotation speed of the spindles is increased. Accordingly, when the fleece of fibers is delivered from the nip point of the front rollers, most of the fibers of the fleece of fibers are twisted together by the action of the above-mentioned twist propagation created by the ring-spindle mechanism, but the fibers at the outside positions, separated from the central portion of the fleece of fibers, are separated from the above-mentioned yarn creation when delivered from the nip point of the front rollers, and these fibers spread out into the space surrounding the ring spinning frame. Some of the fibers, which are not firmly caught by the twist-propagation, are also separated from the yarn formation by the action of air created by the ballooning of the yarn, created when the yarn is passing from the snail wire to a traveller of the ring-spindle mechanism, so that these fibers are also spread out into space. The above-mentioned spreading out of the fibers into space is considered to be the main reason for fiber fly in space during the spinning operation, and it can be understood that this phenomenon is more remarkable when the rotation speed of the spindles is higher.

In spinning factories, a special element called a collector, which functions to guide all fibers of the above-mentioned fleece of fibers delivered from the nip zone of the aprons to the nip point of the front rollers, is utilized to prevent the separation of fibers from the fleece of fibers. Nevertheless, it is a common knowledge that it is impossible to maintain the function of the collectors in a perfect condition and accordingly, currently there is a tendency to not utilize the collector in practical mill operations. It must be further recognized that, even if the above-mentioned loss of yarn thickness during the spinning operation can be almost eliminated by utilizing collectors, the problem of maintenance mentioned above cannot be solved, and as a result, the utilization of collectors is not a practical solution to problem of a loss of yarn thickness, from the viewpoint of quality control.

The basic technical concept of the present invention is that the above-mentioned problem of a loss of yarn thickness can be solved by compensating the loss of yarn thickness to produce a yarn having a thickness which satisfies the requirements of quality control. Therefore, to realize the above-mentioned technical concept, the relationship between the loss of yarn thickness of a particular yarn and the rotation speed of the spindles is first clarified, and then the basic concept of how to compensate the loss of yarn thickness by changing the total draft of the drafting mechanism is based upon the above-mentioned clarified relationship between the loss of yarn thickness and the rotation speed of the spindles, and accordingly, a pertinent control program for carrying out the spinning operation, with regard to the relationship between the rotation speed of the spindles and the total draft, can be made.

Next, the first embodiment of the present invention is explained in detail.

In the first embodiment of the present invention, the rotation speed of the spindles is automatically changed according to the speed control program wherein, when a unit spinning operation to produce full packaged cops is started, the rotation speed of the spindles is increased to a first step speed S1 until a bottom tapered portion of a yarn package formed on a bobbin mounted on each spindle is formed. The above-mentioned yarn package is hereinafter simply called a cop. The spindles are driven at this speed S1, to create a stable spinning condition with a basic total draft, for a predetermined time, for example, until the volume of the cop becomes 85% of the full packaged cop, and thereafter, the rotation speed of the spindles is stepwisely increased via a speed S2 to the maximum driving speed S3 thereof, until the volume of the cop reaches predetermined value such as 30% of the full packaged cop, while the total draft is regulated according to the draft change program by which the loss of yarn thickness can be compensated. After continuing to drive the spindles at the maximum driving speed S3, until the volume of the cop reaches a predetermined value such as 90% of the full packaged cop, then the rotation speed of the spindles is reduced to a speed such as S2, for a predetermined period to ensure a stable spinning condition while regulating the total draft according to the draft program, and then the rotation of the spindles is stepwisely decreased to stop the spinning operation.

Figure 5:
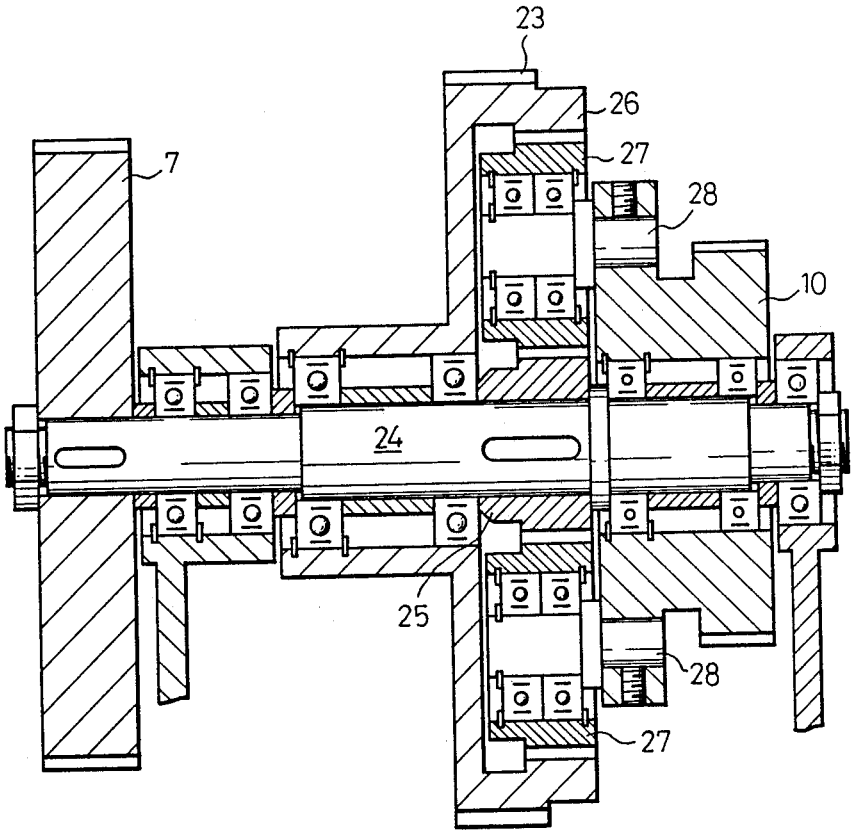
FIG. 5 is a cross sectional view of a transmission mechanism utilized for the mechanical drive system shown in FIG. 2.

The above-mentioned control system for driving the ring spinning system is hereinafter explained in detail with reference to FIGS. 1, 5 and 6.

Figure 2:
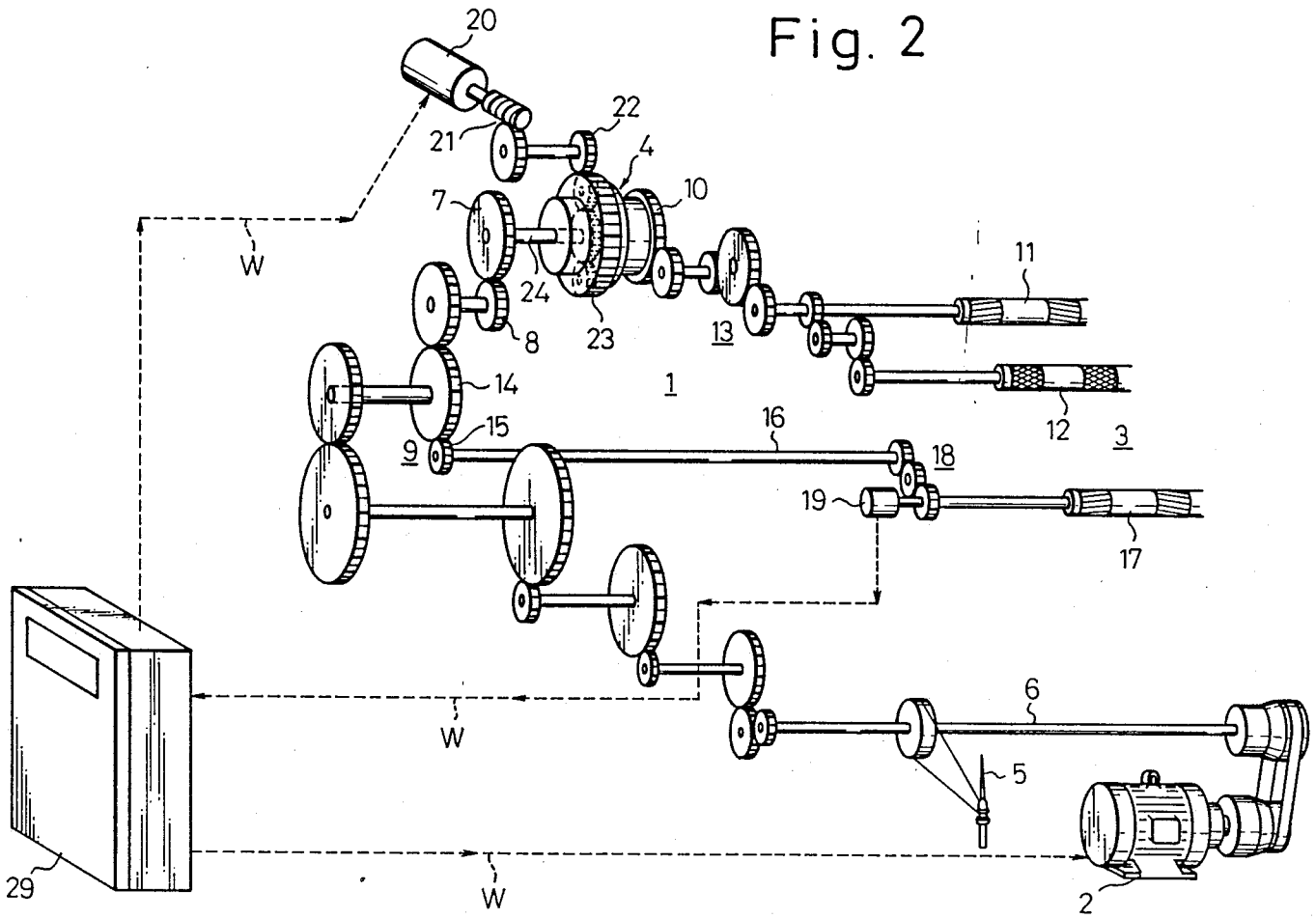
FIG. 2 is an explanatory drawing of a mechanical drive system of a ring spinning frame according to the present invention.

In FIG. 2, indicating the system of driving the ring spinning frame, the driving of a main motor (variable speed) is transmitted to each draft part 3 by way of gear trains of the drive system. A transmission 4 comprising differential gears is arranged in a drive system 1, which can be separated into three component drive systems. Namely, a first component drive system 9 transmitting a drive power from the main motor 2 to a gear 8 which is meshed with an input gear 7 of the transmission 4, via a drive shaft 6 which drives the spindles 5, a second drive system 13 for transmitting the drive power from an output gear 10 of the transmission 4 to a middle roller 12 via a back roller 11, a third drive system 18 for transmitting the drive power from a gear 15, which is in mesh with a gear 14 of the first drive system, to a front roller 17 via a shaft 16. A detector 19 is mounted on the shaft of front roller 17, by which the rotation speed of the front roller 17 is detected.

In FIG. 2, a servo motor 20 is arranged in such way that the rotation of the servo motor 20 is input the differential device 4 by way of an input gear 23 thereof via a gear 22 which is driven by a worm gear mechanism 21, to create the action of the device 4. As shown in FIG. 5, when the drive power of the first driving system 9 is input to an input gear 7 secured to a main shaft 24, the main shaft 24 and a sun wheel 25 secured to the main shaft 24 are rotated together, a pair of planetary gears 27, which are in mesh with the sun wheel gear 25 and an inner gear 26 formed on an inside circumferential surface of the input gear 23, are rotated while under the planetary motion on the sun wheel gear 25, which planetary motion drives the output gear 10 which is axially and freely supported by the main shaft 24 and axially holds these planetary gears 27 by respective pins 28. Accordingly, the rotation input from the first drive system 9 is transmitted to the second drive system 13 so that the back roller 11 and the middle roller 12 are driven at the respective drive ratios, instead of maintaining the stopped condition of the input gear 23. The above-mentioned condition of the input gear is created by the braking effect of the worm mechanism of the servo motor 20. A central computer CPU 29 is utilized for controlling the driving of the ring spinning frame according to the present invention, through a program for controlling the driving of the ring spinning frame, whereby the rotation speed of the spindles 5 is changed by changing the driving speed of the main motor 2 according to an instruction signal issued from the detecting device 19. On the other hand, the rotation speed of the back roller 11 in response to the speed variation of the spindles 5 by actuating the servo motor 20 so that the total draft of each drafting device is changed, is stored in this central computer CPU 29, and the CPU 29 is connected with the detector 19, the servo motor 20, and the main motor 2 by electric wiring W.

In the above-mentioned construction of the drive system, a standard condition such that the basic rotation speed of the spindles 5 is 16,000 rpm and the total draft is 30, to produce a cotton yarn of 40's (cotton count system), is provided. In this basic condition, even if the rotation speed of the spindles is increased to a speed such as 25,000 rpm, a possible loss of yarn thickness, for example, a thickness-loss of 2%, can be compensated by regulating the total draft according to the control method of the present invention. The above-mentioned method for controlling the driving of the ring spinning frame is hereinafter explained in more detail.

Figure 6:
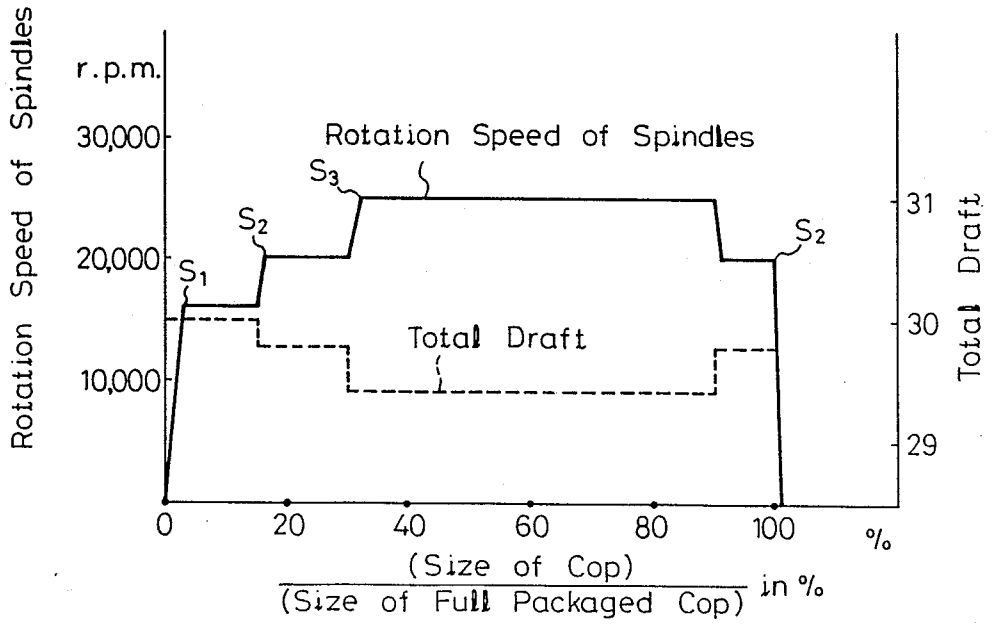
FIG. 6 is an explanatory drawing of a principle of controlling the driving of the ring spinning frame according to the present invention, wherein the total draft of draft parts of the spinning frame is stepwise changed in accordance with stepwise changes of the rotation speed of the spindles of the ring spinning frame.

When the spindles 5 are driven at the basic rotation speed (S1) of 16,000 rpm, by driving the main motor 2 as shown in FIG. 6, this drive motion is transmitted to each draft part 3 by way of the first, second, and third drive systems 9, 13 and 18, so that the back, middle and front rollers 11, 12 and 17 are rotated at the respective drive ratios. Accordingly, a fleece of fibers introduced into each draft part 3 is subjected to a drafting action of the draft of 30 so that a cotton yarn of 40's is produced, while the length of the yarn produced is measured by counting the number of rotations of the front roller 17 by the detector 19. The servo motor 20 is not actuated until the detector 19 detects that a predetermined length of yarn, for example, 15% of the total length of yarn forming one full packaged cop delivered from the front roller 11, is detected and when the detector detects that such a predetermined length of yarn has been delivered from the front roller 11, the detector outputs a signal to the CPU so that an instruction signal is issued from the CPU, according to the program memorized in the CPU, to the main motor 2, and thus the rotation speed of the main motor 2 is increased to rotate the spindles 5 by the second speed S2, that is 20,000 rpm. The spinning condition has left a starting period of forming a cop, which is unstable when forming the bottom end portion of the cop, so that the spinning condition is established as a stable spinning condition. The size of the cop has reached almost 15% of the full packaged cop at this time.

When the rotation speed of the main motor 2 is increased, to increase the rotation speed of the spindles 5 to the speed S2, the rotation speeds of all of the machine elements of the first drive system are also increased, at the same ratio as the ratio at which rotation speed of the spindles 5 is increased, while the total draft of each draft part 3 is maintained at the same condition as the condition before changing the rotation speed of the main motor 2, as can be easily understood from the construction shown in FIG. 2. Therefore, when the rotation speed of the spindles 5 is increased to 20,000 rpm, the yarn count is changed to 40.3s.

To compensate for the loss of yarn thickness, in the present invention, when a signal for increasing the speed of the main motor 2 is output, the CPU 29 simultaneously outputs a signal to the servo motor 20 to regulate the output rotation speed thereof to a predetermined number of rotations. When the rotation of the servo-motor 20 is input to the input gear 23 of the transmission 4, this input is added to the rotation of the planetary gears 27, which are in a planetary motion around the sun-gear 25, while meshing with the sun-gear 25, which is rotated by the input from the input gear 26. Accordingly, the output of the output gear 10 is regulated such that a new condition is created by the additional rotation speed created by the servo motor 20, which is added to the rotation speed based upon the first drive system 9. Therefore, the rotation speed of the second drive system 13 is raised by the above-mentioned additional rotation speed created by the motion of the servo motor 20, and accordingly, the rotation speeds of the back rollers 11 and the middle rollers 12 are relatively increased to the rotation speed of the front roller, i.e., the draft ratio is reduced. Namely, when the rotation speed of the spindles 5 is increased to 20,000 rpm (speed S2), the second drive system 13 is rotated, as mentioned above, to change the total draft of 30 to 29.78, and as a result of such a change of the total draft of the draft parts, the above-mentioned loss of yarn thickness produced by each draft part, which is created by increasing the rotation speed of the spindles 5, can be compensated.

As mentioned above, the spinning operation is carried out for a predetermined period until the detector 19 detects that the yarn having a predetermined length, such as 30% of the total length of a full packaged cop, has been produced. When the detector 19 detects the above-mentioned condition, the CPU 29 issues an actuation signal to increase the rotation speed of the main motor 2, and the rotation speed of the spindles 5 is increased to its maximum speed S3, 25,000 rpm, until the size of the cop of each spindle 5 has become almost 30% of the full packaged cop and the spinning condition has become stable. Accordingly, even if the rotation speed of the spindles 5 is increased to a maximum speed S3 such as 25,000 rpm, the spinning operation can be carried out without trouble. When the rotation speed of the spindles 5 is increased as mentioned above, the CPU 29 outputs an actuation signal to the servo-motor 20, so that the servo motor rotates at a predetermined rotation speed which is higher than the rotation speed thereof at the time of increasing the rotation speed of the spindles 5 to 20,000 rpm. According to the above-mentioned regulation of the rotation speed of the servo motor 20, the rotation speed of the back roller 11 and the middle roller 12 are further increased so that the total draft of each draft part is changed to 29.41, while the rotation speed of the spindles is maintained at its maximum speed S3, 25,000 rpm. Therefore, the possible loss of yarn thickness created by driving the spindles 5 at 25,000 rpm in the condition of a total draft of 30 can be compensated. Thereafter, the spinning operation is continued until the size of each cop becomes almost 90% of the full packaged cop. When the size of the cop becomes 90% of the full packaged cop, as shown in the program lines of FIG. 6, the rotation speed of the spindles 5 is stepwisely reduced to its second speed S2, 20,000 rpm, according to the predetermined condition of the program, and the spinning is carried out in this condition until a full packaged cop is produced by each spindles, and thereafter, the driving of the spinning frame is stopped rapidly. When the spindle speed is lowered, as mentioned above, the rotation speed of the servo motor 20 is simultaneously returned to the previous condition wherein the spindle speed was increased from 16,000 rpm to 20,000 rpm, so that the total draft was changed to 29.78. Accordingly, a possible increase of thickness of yarn can be prevented. As mentioned above, every time rotation speed of the spindles is changed, the total draft of each draft part is regulated to prevent a possible change of the yarn count (loss or increase of the yarn thickness) according to the data concerning the relationship between the thickness of the yarn and the rotation speed of the spindles, which was previously measured. And if it is necessary to compensate a possible increase of yarn thickness after the above-mentioned change of rotation speed of spindles 5 until the full packaged cop is formed in the condition of without further regulating the total draft, the servo motor 20 is further operated for a while until the rotation speed of the spindles 5 becomes to its standard speed S1, so as to compensate the possible increase of yarn thickness. The time of continuously rotating the servo motor 20 can be controlled by a known method such as utilizing a timer relay.

Figure 3:
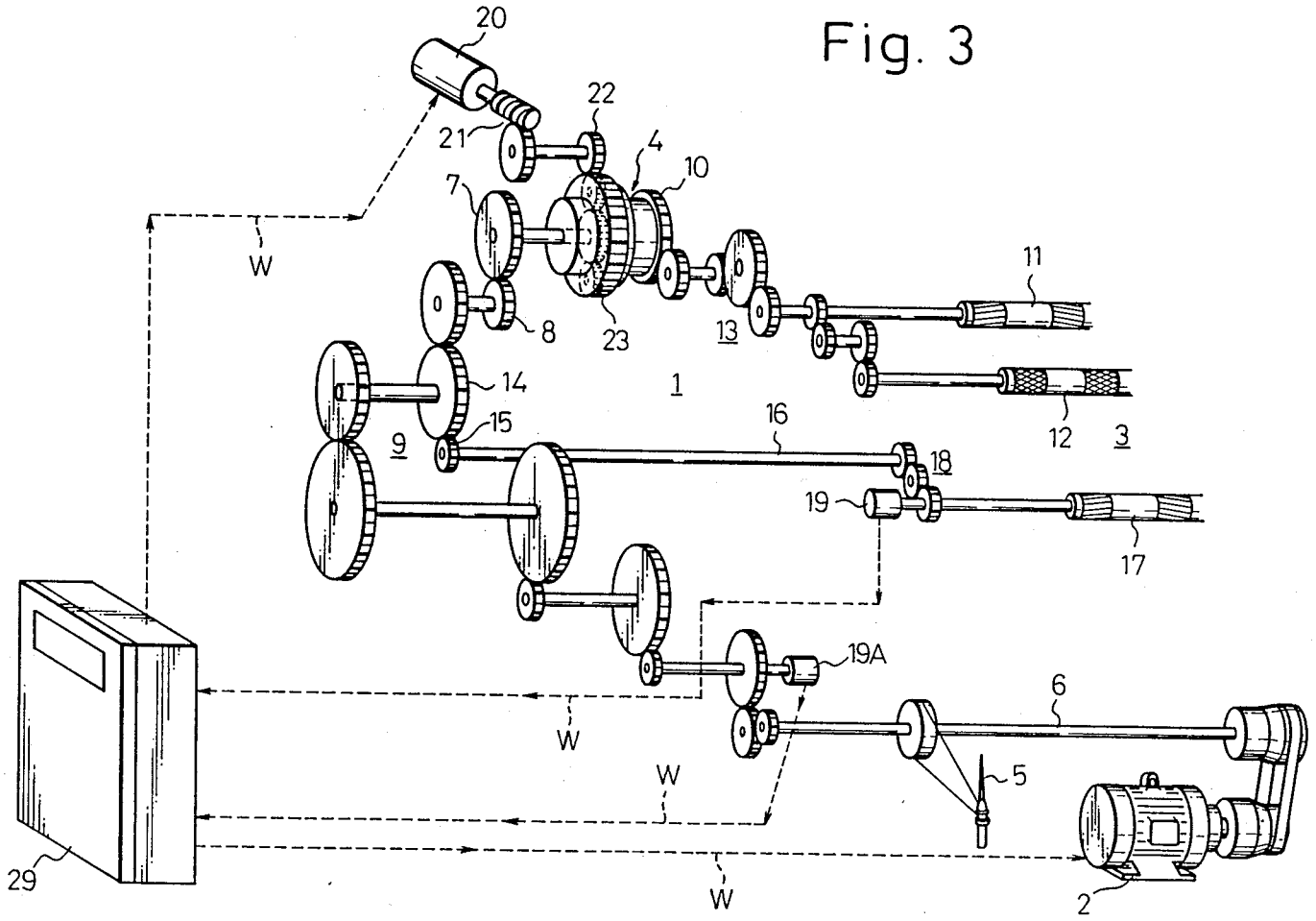
FIGS. 3 and 4 show other mechanical drive systems according to the present invention.

The second embodiment of the present invention is explained in detail with reference to FIG. 3. In FIG. 3, the construction of the drive system of the spinning frame is almost identical to that of the spinning frame shown in FIG. 2, except that a detector 19A is utilized to detect the rotation speed of the spindles 5. Accordingly, the basic technical concept of this second embodiment is understood to be the same as that of the first embodiment.

In this embodiment, the detector 19 detects the length of yarn of a cop while the detector 19A detects the rotation speed of the spindles 5, and signals output from the detectors 19 and 19A are input to the CPU 29, respectively, when it is detected that the size of the cop has become 15% of the full packaged cop, an actuation signal to increase the spindle speed from 16,000 rpm to 20,000 rpm is output from the CPU 29. On the other hand, when it is confirmed by the detector 19A that the rotation speed of the spindles 5 has reached 20,000 rpm, the CPU issues a signal to continuously drive the motor 2 in this condition for a predetermined period, according to the given program concerning the rotation speed of the spindles 5. When the rotation speed of the spindles 5 is changed as mentioned above, the CPU simultaneously outputs a signal to drive the servo motor 20 at the predetermined rotation speed to regulate the total draft of each draft part in the same manner as in the above-mentioned first embodiment. The rotation speed of the spindles 5 and the total draft of each draft part are further changed until the formation of the full packaged cop is completed, in the same manner as mentioned above, and those changes are made according to programs such as the programs applied to the first embodiment. Therefore, an explanation thereof is omitted.

Figure 4:
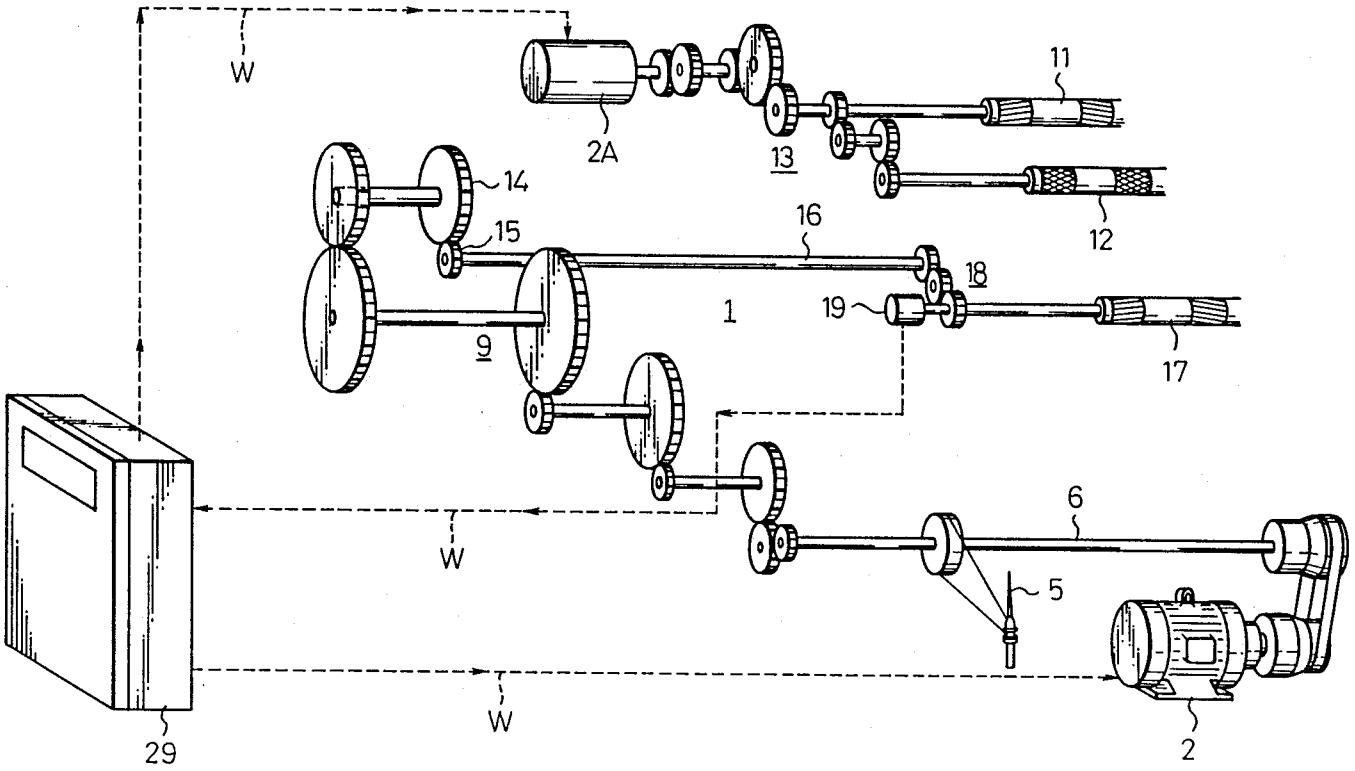

In the third embodiment, the servo motor and the transmission utilized in the first and second embodiments are omitted. Namely, as is clear from FIG. 4, the first drive system 9 and the third drive system 18 are driven by the main motor 2, while the second driving system 13 is driven by an independent drive motor 2A. In this embodiment, the rotation speed of the spindles 5 and the rotation speed of the front roller 17 are controlled by the rotation speed of the main motor 2, while the rotation speeds of the back roller 11 and the middle roller 12 follow the rotation speed of the drive motor 2A, independently from the main motor 2. The CPU functions to control the rotation speeds of the main motor 2 and the drive motor 2A simultaneously and separately, according to the predetermined programs related to the rotation speed of the spindles 5 and the total draft. Since the relationship between the predetermined program of the rotation speed of the spindles 5 and the predetermined program of the total draft is identical to the programs applied to the first embodiment, a detailed explanation thereof is omitted.

As it is clearly explained in the above three embodiments, when the rotation speed of the spindles 5 is higher than a predetermined speed S1, for example, 16,000 rpm when producing 40s cotton yarn, the possible loss of yarn thickness is automatically compensated by regulating the total draft of each draft part, and accordingly, it is possible to produce a full packaged cop at each spindle while obtaining a desired yarn quality, from the viewpoint of quality control. Accordingly, if the above-mentioned basic technical concept can be satisfied, any type of drive system, in addition to the above-mentioned embodiments, can be utilized for the purpose of the present invention.

In the above-mentioned embodiments, after the size of cop becomes to 90% of the full packaged cop, the rotation speed of the spindles 5 is changed to its second speed S2, and thereafter constantly reduced to zero, while the total draft is also regulated in response to the above-mentioned change of the rotation speed of the spindles 5 to the second speed S2, however, instead of applying one step changes of rotation speed of the spindles 5 and total draft, two steps change thereof like the starting period of forming a full packaged cop explained in these embodiments can be applied. Instead of applying such stepwisely changes of the rotation speed of spindles 5 and the total draft, such control system as that, in the periods of forming a bottom and a top portion of each cop, when the rotation speed of the spindles 5 is controlled to a speed higher than a predetermined speed such as 16,000 rpm in a case of producing a cotton yarn of 40's, the total draft is regulated as mentioned above, can be successfully applied.

Any electric control system can be applied, so long as an identical result as obtained in the above-mentioned embodiments can be attained for regulating the rotation speed of the spindles while regulating the total draft of the draft parts.

In these embodiments, the size of a cop, i.e., the length of yarn produced, is measured directly by the number of rotations of the front roller, but the rotation speed of the spindles and the total draft can be regulated by predetermined programs, which are based upon such parameters as the lapse of time after starting the spinning operation to produce a full packaged cop by each spindle.

In the above-mentioned embodiments, the case of producing 40s cotton yarn is particularly explained as an example, but if the raw material used to produce the yarn, the yarn count, and the conditions such as the twists of the yarn, etc., are different, the relationship between the rotation speed of the spindles and the loss of yarn thickness is naturally different. Therefore, it is practical to confirm the above-mentioned relationship before designing the control program for carrying out the method of the present invention.

As clearly explained above, since the total draft of each draft part of a ring spinning frame is regulated to compensate the possible loss of yarn thickness when the rotation speed of the spindles is higher than a predetermined limit, such as 16,000 rpm in the case of producing a cotton yarn of 40's, in the condition wherein the rotation speed of the spindles is changed between a low speed and a very high speed in accordance with the size of cop, a possible variation of yarn count due to the above-mentioned change of the rotation speed of the spindles can be effectively compensated, and a possible creation of yarn count variations within a full packaged cop can be prevented. Namely, the method of controlling the driving of a ring spinning frame according to the present invention contributes to the creation of a desirable quality control, to maintain the yarn count in a precise condition.

What is claimed is:

1. In a method of driving a ring spinning frame provided with a plurality of spindles driven to produce full packaged cops thereby, while controlling a rotation speed thereof with a predetermined program wherein said rotation speed of said spindles is stepwisely increased from zero to a predetermined maximum value of said rotation speed via at least a predetermined intermediate value of said rotation speed, said spindles are then driven at said maximum rotation speed to create a main portion of said full packaged cop, and finally, said rotation speed is stepwisely reduced to zero via at least said intermediate rotation speed, for producing a particular yarn in a form of a full packaged cop, with a predetermined total draft, an improvement comprising, previously measuring a relationship between loss of thickness of said particular yarn and said rotation speed of spindles, when said rotation speed of said spindles is higher than a predetermined rotation speed, automatically regulating said total draft in a reverse condition to compensate said possible loss of thickness of said particular yarn each time said rotation speed of said spindles is changed in such a condition that said rotation speed of said spindles is higher than said predetermined rotation speed in accordance with said relationship between a loss of thickness of said particular yarn and said rotation speed of said spindles.

2. An improved method of driving a ring spinning frame according to claim 1, wherein said program of stepwisely changing said rotation speed of said spindles includes a parameter based upon a length of yarn produced by each of said spindles, said program of regulating said rotation speed of said spindles is operated each time when predetermined lengths of said yarn are detected, said total draft is regulated simultaneously at each time of changing said rotation speed of said spindles in a condition being higher than said predetermined rotation speed.

3. An improved method of driving a ring spinning frame according to claim 1, wherein, said program of stepwisely changing said rotation speed of said spindles includes a parameter based upon predetermined elapsed times from a starting time of creating said full packaged cop, said program of regulating said rotation speed of said spindles is operated each time of an elapse of predetermined times from said starting time, said total draft is regulated each time of changing said driving speed of said spindles in a condition being higher than said predetermined driving speed.

* * * * *